US011761742B1

(12) United States Patent
Young et al.

(10) Patent No.: US 11,761,742 B1
(45) Date of Patent: Sep. 19, 2023

(54) AMMUNITION TUNED FOR A GIVEN FIREARM BARREL LENGTH AND SYSTEM AND METHOD FOR MAKING THE SAME

(71) Applicants: Gregory Young, Minneapolis, MN (US); Frederick Hazzard, Andover, MN (US); Michael Young, Minneapolis, MN (US)

(72) Inventors: Gregory Young, Minneapolis, MN (US); Frederick Hazzard, Andover, MN (US); Michael Young, Minneapolis, MN (US)

( * ) Notice: Subject to any disclaimer, the term of this patent is extended or adjusted under 35 U.S.C. 154(b) by 456 days.

(21) Appl. No.: 16/418,208

(22) Filed: May 21, 2019

Related U.S. Application Data

(60) Provisional application No. 62/675,477, filed on May 23, 2018.

(51) Int. Cl.

| | |
|---|---|
| ***F42B 33/02*** | (2006.01) |
| ***F42B 5/02*** | (2006.01) |
| ***F42B 5/16*** | (2006.01) |
| ***F41A 21/00*** | (2006.01) |
| *F42B 30/02* | (2006.01) |
| *F41A 31/00* | (2006.01) |

(52) U.S. Cl.
CPC ..... *F42B 33/0292* (2013.01); *F42B 5/02* (2013.01); *F42B 5/16* (2013.01); *F42B 33/02* (2013.01); *F42B 33/0285* (2013.01); *F41A 21/00* (2013.01); *F41A 31/00* (2013.01); *F42B 30/02* (2013.01)

(58) Field of Classification Search
CPC ..... F42B 5/00; F42B 5/02; F42B 5/16; F42B 33/02; F42B 33/0285; F42B 33/0292; F42B 30/02; F41A 21/00; F41A 31/00; F41A 31/02
USPC .. 102/430; 86/23, 29, 31; 42/76.01; 89/14.05
See application file for complete search history.

(56) References Cited

U.S. PATENT DOCUMENTS

| | | | | |
|---|---|---|---|---|
| 4,852,451 | A * | 8/1989 | Rogers | F42B 33/0285 73/167 |
| 5,798,473 | A * | 8/1998 | Roblyer et al. | F41A 21/36 89/14.3 |
| 10,012,484 | B2* | 7/2018 | Pearlson | G01G 13/16 |
| 2016/0258723 | A1* | 9/2016 | Pearlson | F42B 33/0285 |

OTHER PUBLICATIONS

Optimal Barrel Time Concept - Jun. 16, 2016 http://www.the-long-family.com/optimal%20barrel%20time.htm (Year: 2016).*
Shock Wave Theory— Rifle Internal Ballistics, Longitudinal Shock Waves, and Shot Dispersion, 2004 http://www.the-long-family.com/OBT_paper.htm (Year: 2004).*

* cited by examiner

*Primary Examiner* — James S Bergin
(74) *Attorney, Agent, or Firm* — Gutwein Law; Tyler B. Droste

(57) ABSTRACT

A system and method for the determination of an optimal ammunition round based upon a barrel length of a given firearm and resulting ammunition. The ammunition is preferably provided in a pair of rounds for a given caliber and bullet optimized for a range of barrel lengths, wherein a user can select a preferred round for a given firearm based upon the barrel length.

7 Claims, 11 Drawing Sheets

Caliber: 9mm Luger, Wt (gr): 124, Mfg: Speer, Model: TMJ RN, Mfg P/N: 3993

| | | | | | | | | |
|---|---|---|---|---|---|---|---|---|
| Barrel length | 3.5 | in | Bullet velocity (fps) | 1003 | 306 | crown wave times (CWTs) | | |
| Optimized Barrel Length | 4.5 | in | Barrel time (msec) | 0.4378 | | Wave time < barrel time: | 0.4194 | msec |
| Powder Load | 4.10 | gr | % between EOBWTs | 60% | Target is 25% - 75% | Wave time > barrel time: | 0.4501 | msec |
| Case length | 0.754 | in | Pmax | 28908 | | | | |
| Seating depth | 0.180 | in | NR at 10% Pmax | 2 | | | | |
| Bullet travel | 2.926 | in | Time at 10% Pmax | 0.0074 | | | | |
| Wave speed | 227953 | in/sec | NR at Reflection 2 | 7 | | | | |
| Bullet/wave start pos | 0.574 | in | %Pmax at Reflection 2 | 18% | guideline is >~33% | | | |

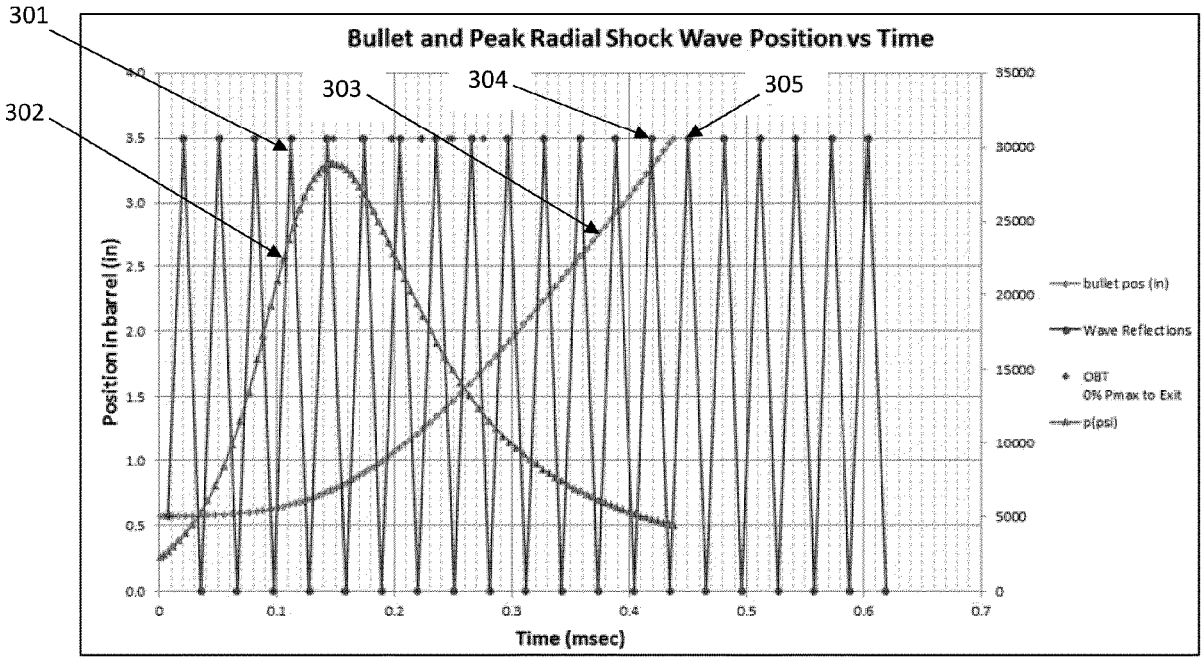

30

Figure 3

Caliber: 9mm Luger, Wt (gr): 124, Mfg: Speer, Model: TMJ RN, Mfg P/N: 3993

| | | | | | | | | |
|---|---|---|---|---|---|---|---|---|
| Barrel length | 4.0 | in | Bullet velocity (fps) | 1031 | | crown wave times (CWTs) | | |
| Optimized Barrel Length | 4.5 | in | Barrel time (msec) | 0.4788 | | Wave time < barrel time: | 0.4787 | msec |
| Powder Load | 4.10 | gr | % between EOBWTs | 0% | Target is 25% - 75% | Wave time > barrel time: | 0.5138 | msec |
| Case length | 0.754 | in | Pmax | 28908 | | | | |
| Seating depth | 0.180 | in | NR at 10% Pmax | 2 | | | | |
| Bullet travel | 3.426 | in | Time at 10% Pmax | 0.0074 | | | | |
| Wave speed | 227953 | in/sec | NR at Reflection 2 | 7 | | | | |
| Bullet/wave start pos | 0.574 | in | %Pmax at Reflection 2 | 18% | guideline is >~33% | | | |

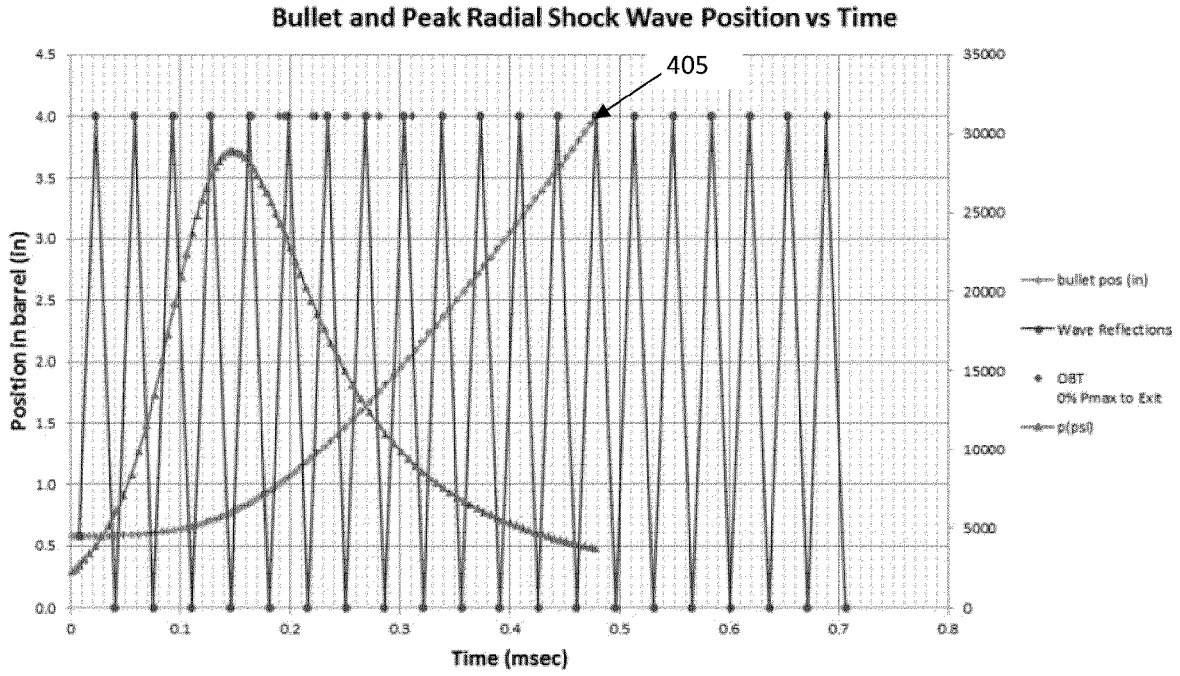

Figure 4

| | | | |
|---|---|---|---|
| Optimized Barrel Length (in) | | | 4.5 |
| Powder | | | Hodgdon Titegroup |
| Charge (gr) | | | 4.1 |
| Primer | | | 0 |
| Brass | | | 0 |
| Pressure (psi) | | | 28908 |
| Max pressure (psi) | | | 35000 |
| Percent of max pressure | | | 83% |
| | | | |
| Barrel length (in) | Bullet Velocity (fps) | Barrel time (msec) | % between CWTs |
| 3.5 | 1003 | 0.4378 | 60% |
| 4.0 | 1031 | 0.4788 | 0% |
| 4.5 | 1055 | 0.5187 | 51% |
| 5.0 | 1075 | 0.5579 | 11% |
| 5.5 | 1092 | 0.5963 | 76% |
| 6.0 | 1107 | 0.6343 | 46% |

Table for copying into Ammunition Spec document:

| Barrel Length (in) | Optimum? | Velocity (ft/sec) | Barrel Time (ms) |
|---|---|---|---|
| 3.5 | Yes | 1003 | 0.4378 |
| 4.0 | No | 1031 | 0.4788 |
| 4.5 | Yes | 1055 | 0.5187 |
| 5.0 | No | 1075 | 0.5579 |
| 5.5 | Marginal | 1092 | 0.5963 |
| 6.0 | Yes | 1107 | 0.6343 |

| | | | |
|---|---|---|---|
| Optimized Barrel Length (in) | | | 5.0 |
| Powder | | | Hodgdon Titegroup |
| Charge (gr) | | | 4.3 |
| Primer | | | 0 |
| Brass | | | 0 |
| Pressure (psi) | | | 31767 |
| Max pressure (psi) | | | 35000 |
| Percent of max pressure | | | 91% |
| | | | |
| Barrel length (in) | Bullet Velocity (fps) | Barrel time (msec) | % between CWTs |
| 3.5 | 1035 | 0.4221 | 95% |
| 4.0 | 1063 | 0.4618 | 40% |
| 4.5 | 1087 | 0.5006 | 95% |
| 5.0 | 1107 | 0.5385 | 57% |
| 5.5 | 1124 | 0.5759 | 25% |
| 6.0 | 1139 | 0.6127 | 97% |

Table for copying into Ammunition Spec document:

| Barrel Length (in) | Optimum? | Velocity (ft/sec) | Barrel Time (ms) |
|---|---|---|---|
| 3.5 | No | 1035 | 0.4221 |
| 4.0 | Yes | 1063 | 0.4618 |
| 4.5 | No | 1087 | 0.5006 |
| 5.0 | Yes | 1107 | 0.5385 |
| 5.5 | Marginal | 1124 | 0.5759 |
| 6.0 | No | 1139 | 0.6127 |

Figure 5

Caliber: 308, Wt (gr): 150, Mfg: Sierra, Model: GameKing, Mfg P/N: 2125

| | | | | | | | |
|---|---|---|---|---|---|---|---|
| Barrel length | 24.0 in | Bullet velocity (fps) | 2970 | | crown wave times (CWTs) | | |
| Optimized Barrel Length | 16.0 in | Barrel time (msec) | 1.1194 | | Wave time < barrel time: | 0.9795 | msec |
| Powder Load | 47.40 gr | % between EOBWTs | 66% | Target is 25% - 75% | Wave time > barrel time: | 1.1901 | msec |
| Case length | 2.014 in | Pmax | 60929 | | | | |
| Seating depth | 0.310 in | NR at 10% Pmax | 7 | | | | |
| Bullet travel | 22.296 in | Time at 10% Pmax | 0.0394 | | | | |
| Wave speed | 227953 in/sec | NR at Reflection 2 | 27 | | | | |
| Bullet/wave start pos | 1.704 in | %Pmax at Reflection 2 | 67% | guideline is >~33% | | | |

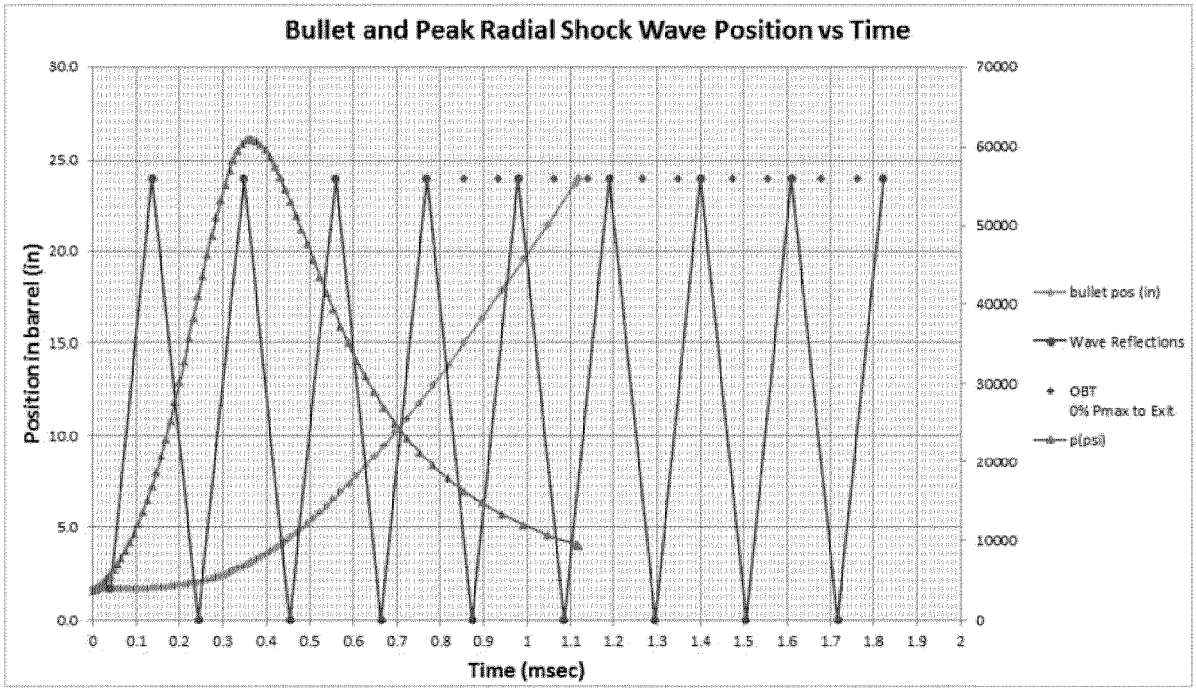

Figure 6

Caliber: 308, Wt (gr): 150, Mfg: Sierra, Model: GameKing, Mfg P/N: 2125

| | | | | | | | | | |
|---|---|---|---|---|---|---|---|---|---|
| Barrel length | 26.0 | in | Bullet velocity (fps) | 3017 | | | End of barrel wave times (EOBWTs) | | |
| Optimized Barrel Length | 16.0 | in | Barrel time (msec) | 1.1751 | | | Wave time < barrel time: | 1.0585 | msec |
| Powder Load | 47.40 | gr | % between EOBWTs | 51% | Target is 25% - 75% | | Wave time > barrel time: | 1.2866 | msec |
| Case length | 2.014 | in | Pmax | 60929 | | | | | |
| Seating depth | 0.310 | in | NR at 10% Pmax | 7 | | | | | |
| Bullet travel | 24.296 | in | Time at 10% Pmax | 0.0394 | | | | | |
| Wave speed | 227953 | in/sec | NR at Reflection 2 | 28 | | | | | |
| Bullet/wave start pos | 1.704 | in | %Pmax at Reflection 2 | 71% | guideline is >~33% | | | | |

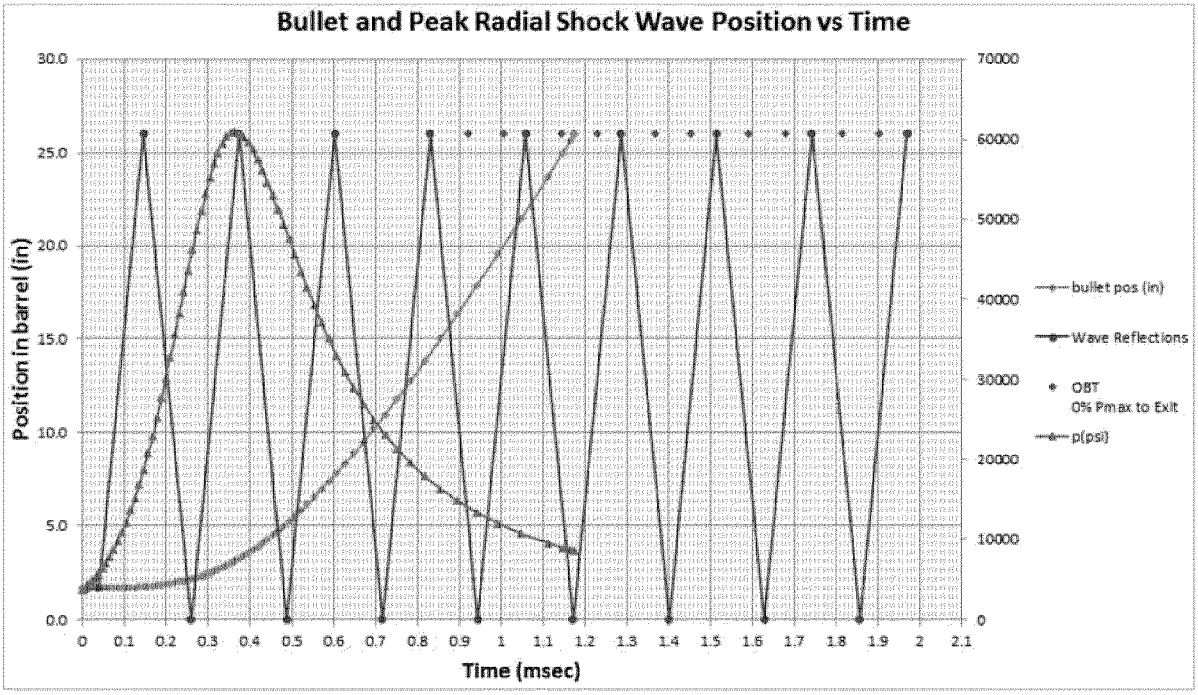

Figure 7

Caliber: 308, Wt (gr): 150, Mfg: Sierra, Model: GameKing, Mfg P/N: 2125

| | | | | | | | | | |
|---|---|---|---|---|---|---|---|---|---|
| Barrel length | 20.0 | in | Bullet velocity (fps) | 2857 | | | crown wave times (CWTs) | | |
| Optimized Barrel Length | 16.0 | in | Barrel time (msec) | 1.0051 | | | Wave time < barrel time: | 0.9970 | msec |
| Powder Load | 47.40 | gr | % between EOBWTs | 5% | Target is 25% - 75% | | Wave time > barrel time: | 1.1725 | msec |
| Case length | 2.014 | in | Pmax | 60929 | | | | | |
| Seating depth | 0.310 | in | NR at 10% Pmax | 7 | | | | | |
| Bullet travel | 18.296 | in | Time at 10% Pmax | 0.0394 | | | | | |
| Wave speed | 227953 | in/sec | NR at Reflection 2 | 23 | | | | | |
| Bullet/wave start pos | 1.704 | in | %Pmax at Reflection 2 | 50% | guideline is >~33% | | | | |

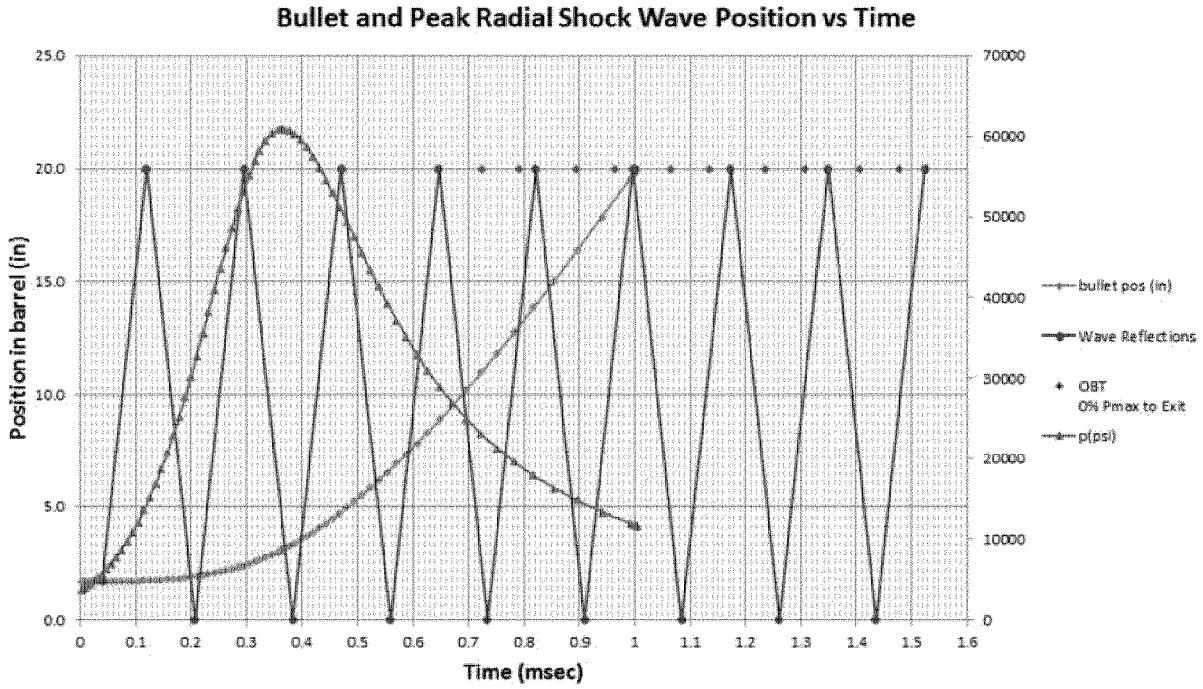

Figure 8

| | | | |
|---|---|---|---|
| Optimized Barrel Length (in) | | | 16.0 |
| Powder | | | H4895 |
| Charge (gr) | | | 47.4 |
| Primer | | | 0 |
| Brass | | | 0 |
| Pressure (psi) | | | 60929 |
| Max pressure (psi) | | | 62000 |
| Percent of max pressure | | | 98% |
| | | | |
| Barrel length (in) | Bullet Velocity (fps) | Barrel time (msec) | % between CWTs |
| 14.5 | 2635 | 0.8386 | 84% |
| 16 | 2706 | 0.8854 | 58% |
| 17 | 2749 | 0.9159 | 43% |
| 18 | 2787 | 0.9460 | 29% |
| 19 | 2823 | 0.9757 | 16% |
| 20 | 2857 | 1.0051 | 5% |
| 21 | 2888 | 1.0341 | 94% |
| 22 | 2917 | 1.0628 | 84% |
| 23 | 2944 | 1.0912 | 75% |
| 24 | 2970 | 1.1194 | 66% |
| 25 | 2994 | 1.1474 | 59% |
| 26 | 3017 | 1.1751 | 51% |

Table for copying into Ammunition Spec document:

| Barrel Length (in) | Optimum? | Velocity (ft/sec) | Barrel Time (ms) | | Barrel Length (in) | Optimum ? | Velocity (ft/sec) | Barrel Time (ms) |
|---|---|---|---|---|---|---|---|---|
| 14.5 | No | 2635 | 0.8386 | | 21 | No | 2888 | 1.0341 |
| 16 | Yes | 2706 | 0.8854 | | 22 | No | 2917 | 1.0628 |
| 17 | Yes | 2749 | 0.9159 | | 23 | Yes | 2944 | 1.0912 |
| 18 | Yes | 2787 | 0.9460 | | 24 | Yes | 2970 | 1.1194 |
| 19 | No | 2823 | 0.9757 | | 25 | Yes | 2994 | 1.1474 |
| 20 | No | 2857 | 1.0051 | | 26 | Yes | 3017 | 1.1751 |

Figure 9

| | | | |
|---|---|---|---|
| Optimized Barrel Length (in) | | | 19.0 |
| Powder | | | H4895 |
| Charge (gr) | | | 44.7 |
| Primer | | | 0 |
| Brass | | | 0 |
| Pressure (psi) | | | 50931 |
| Max pressure (psi) | | | 62000 |
| Percent of max pressure | | | 82% |
| | | | |
| Barrel length (in) | Bullet Velocity (fps) | Barrel time (msec) | % between CWTs |
| 14.5 | 2478 | 0.8987 | 37% |
| 16 | 2549 | 0.9484 | 8% |
| 17 | 2591 | 0.9808 | 91% |
| 18 | 2630 | 1.0128 | 76% |
| 19 | 2666 | 1.0442 | 62% |
| 20 | 2700 | 1.0753 | 49% |
| 21 | 2731 | 1.1060 | 37% |
| 22 | 2761 | 1.1363 | 26% |
| 23 | 2788 | 1.1664 | 16% |
| 24 | 2814 | 1.1961 | 6% |
| 25 | 2838 | 1.2256 | 98% |
| 26 | 2862 | 1.2549 | 89% |

Table for copying into Ammunition Spec document:

| Barrel Length (in) | Optimum? | Velocity (ft/sec) | Barrel Time (ms) | | Barrel Length (in) | Optimum ? | Velocity (ft/sec) | Barrel Time (ms) |
|---|---|---|---|---|---|---|---|---|
| 14.5 | Yes | 2478 | 0.8987 | | 21 | Yes | 2731 | 1.1060 |
| 16 | No | 2549 | 0.9484 | | 22 | Yes | 2761 | 1.1363 |
| 17 | No | 2591 | 0.9808 | | 23 | No | 2788 | 1.1664 |
| 18 | Marginal | 2630 | 1.0128 | | 24 | No | 2814 | 1.1961 |
| 19 | Yes | 2666 | 1.0442 | | 25 | No | 2838 | 1.2256 |
| 20 | Yes | 2700 | 1.0753 | | 26 | No | 2862 | 1.2549 |

Figure 10

AMMUNITION TUNED FOR A GIVEN FIREARM BARREL LENGTH AND SYSTEM AND METHOD FOR MAKING THE SAME

CROSS REFERENCE TO RELATED APPLICATIONS

This U.S. Pat. Application claims priority to U.S. Provisional Application 62/675477 filed May 23, 2018 to the above-named inventors, the disclosure of which is considered part of the disclosure of this application and is hereby incorporated by reference in its entirety.

FEDERALLY SPONSORED RESEARCH OR DEVELOPMENT

Not Applicable

SEQUENCE LISTING, A TABLE, OR A COMPUTER PROGRAM

Not Applicable

FIELD OF THE INVENTION

The invention relates generally to an ammunition round and a system and method for determining the optimal load for the given round of ammunition based upon a barrel length of a given firearm the ammunition is used within.

BACKGROUND

A typical round of ammunition generally refers to an assembly of materials configured to direct a projectile towards a target. This typical round includes a cartridge or case having a predetermined diameter and interior cavity for the placement of a volume of gunpowder that is enclosed by a bullet seated within the case. Generally, to ignite the powder within the case for projecting the bullet, the cartridge includes a primer. Together the amount of gunpowder within the cartridge, the depth of the bullet seated within the cartridge, and the addition of the primer is called the "load".

Currently a commercially available and manufactured round or cartridge of ammunition is generally provided in a single load of powder within a casing retained by a bullet. During use of this ammunition within a given firearm, a user may notice that the given round is not optimally precise, wherein a projected bullet is not striking a target at the intended location. Typically, a user will then select an alternate ammunition load or type and through trial and error try to find a given round that works optimally with their given firearm. Generally, a user will typically explain this process as the firearm either liking or disliking a given type of an ammunition round.

Alternate to purchasing a commercially available manufactured round, some users assemble their own ammunition rounds through a hand loading process. This process allows a given user to also use trial and error to determine the best loading parameters, typically in form of the amount of gunpowder added to the cartridge by weight measured ingrains, type of gunpowder, and a seating depth for the bullet within the casing, for a given firearm from which future rounds can be optimized.

During the firing of a given round of ammunition from a firearm a barrel of the firearm is subjected to a number of vibrations. The most important of these vibrations is the increase and decrease in the interior diameter of the barrel that travels back and forth along a length of the barrel at the speed of sound in steel (~227953 inches/second). This barrel diameter vibration wave generally starts at a cartridge chamber and reflects back when it reaches each end of the barrel.

To produce an ammunition that provides optimal or near optimal precision, these vibrations need to be considered in the loading of a given ammunition. According to a published research paper entitled Shock Wave Theory-Rifle Internal Ballistics, Longitudinal Shock Waves, and Shot Dispersion, vibration waves were analyzed and a mathematical formula created to determine the optimal time at which a given bullet should exit the barrel of a given firearm for optimum precision and insensitivity to load variation. The analysis further shows that there are two (2) times between vibration wave cycles when the diameter of the barrel is not changing and providing an optimal barrel time ("OBT") for a given barrel length. The longitudinal shock wave is not the same thing as the transverse vibration wave in a barrel which most people are familiar with. The key variable in understanding both forms of vibrations turns out to be the length of the barrel.

Therefore, for optimal precision, a system and method is provided to calibrate a given ammunition to a given firearm. Preferably, this system and method is configured to provide a range of ammunition loadings that is optimized for a given firearm barrel length.

BRIEF DESCRIPTION OF THE FIGURES AND DRAWINGS

The disclosure may be more completely understood in consideration of the following detailed description of various illustrative embodiments in connection with the accompanying figures, in which:

FIG. 3 is a calculation input table and resulting graph for an example 9 mm Luger handgun round in a 3.5-inch length barrel;

FIG. 4 is a calculation input table and resulting graph for the same example round in FIG. 3, but in a 4.0-inch length barrel;

FIG. 5 is an illustration of 2 different example 9 mm Luger loads that have been designed for an example range of barrel lengths from 3.5 inches to 6.0 inches;

FIG. 6 is a calculation input table and resulting graph for an example .308 Winchester rifle round in a 24-inch length barrel;

FIG. 7 is a calculation input table and resulting graph for the same example round in FIG. 6, but in a 26-inch length barrel;

FIG. 8 is a calculation input table and resulting graph for the same example round in FIG. 6, but in a 20-inch length barrel;

Figure 11:
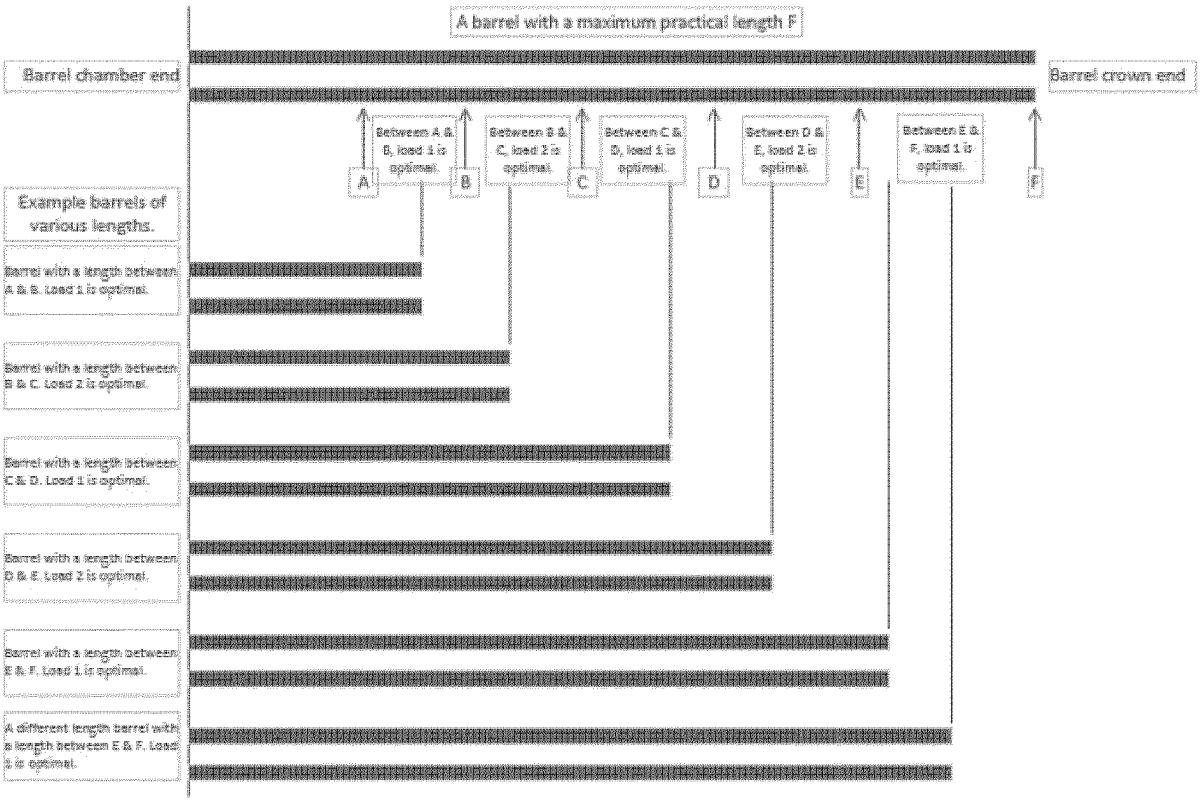

FIG. 9 is an illustration of an example .308 Winchester rifle load that has been designed for an example sub-set range of barrel lengths in the range of 14.5 inches to 26 inches in length; and FIG. 10 is an illustration of an example .308 Winchester rifle load that has been designed for an example sub-set range of barrel lengths from 14.5 inches to 26 inches in length, said sub-set being the barrel lengths not covered by the load illustrated in FIG. 9; and FIG. 11 is illustration showing a theoretical barrel with a maximum practical length identified as variable F, this illustration indicates the optimal load selected between a first load and a second load along the practical length F.

DETAILED DESCRIPTION OF THE INVENTION

The following detailed description includes references to the accompanying tables and figures, which form a part of the detailed description. The tables and figures show, by way of illustration, specific embodiments in which the invention may be practiced. These embodiments, which are also referred to herein as "examples," are described in enough detail to enable those skilled in the art to practice the invention. The embodiments may be combined, other embodiments may be utilized, or structural, and logical changes may be made without departing from the scope of the present invention. The following detailed description is, therefore, not to be taken in a limiting sense.

Before the present invention is described in such detail, however, it is to be understood that this invention is not limited to particular variations set forth and may, of course, vary. Various changes may be made to the invention described and equivalents may be substituted without departing from the true spirit and scope of the invention. In addition, many modifications may be made to adapt a particular situation, material, composition of matter, process, process act(s) or step(s), to the objective(s), spirit or scope of the present invention. All such modifications are intended to be within the scope of the disclosure made herein.

Unless otherwise indicated, the words and phrases presented in this document have their ordinary meanings to one of skill in the art. Such ordinary meanings can be obtained by reference to their use in the art and by reference to general and scientific dictionaries.

References in the specification to "one embodiment" indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following explanations of certain terms are meant to be illustrative rather than exhaustive. These terms have their ordinary meanings given by usage in the art and in addition include the following explanations.

As used herein, the term "and/or" refers to any one of the items, any combination of the items, or all of the items with which this term is associated.

As used herein, the singular forms "a," "an," and "the" include plural reference unless the context clearly dictates otherwise.

As used herein, the terms "include," "for example," "such as," and the like are used illustratively and are not intended to limit the present invention.

As used herein, the terms "preferred" and "preferably" refer to embodiments of the invention that may afford certain benefits, under certain circumstances. However, other embodiments may also be preferred, under the same or other circumstances.

Furthermore, the recitation of one or more preferred embodiments does not imply that other embodiments are not useful and is not intended to exclude other embodiments from the scope of the invention.

As used herein, the term "coupled" means the joining of two members directly or indirectly to one another. Such joining may be stationary in nature or movable in nature and/or such joining may allow for the flow of fluids, electricity, electrical signals, or other types of signals or communication between two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element without departing from the teachings of the disclosure.

Referring now to FIGS. 1-11, the system and method of the present disclosure provides an optimal ammunition load for maximizing bullet precision (i.e. minimizing bullet dispersion) of a bullet of a predetermined caliber fired from a given firearm based upon a barrel length 101, defined as a distance from a barrel crown 102 of the firearm to a bullet start position 104, using OBT as guide.

Figure 2:
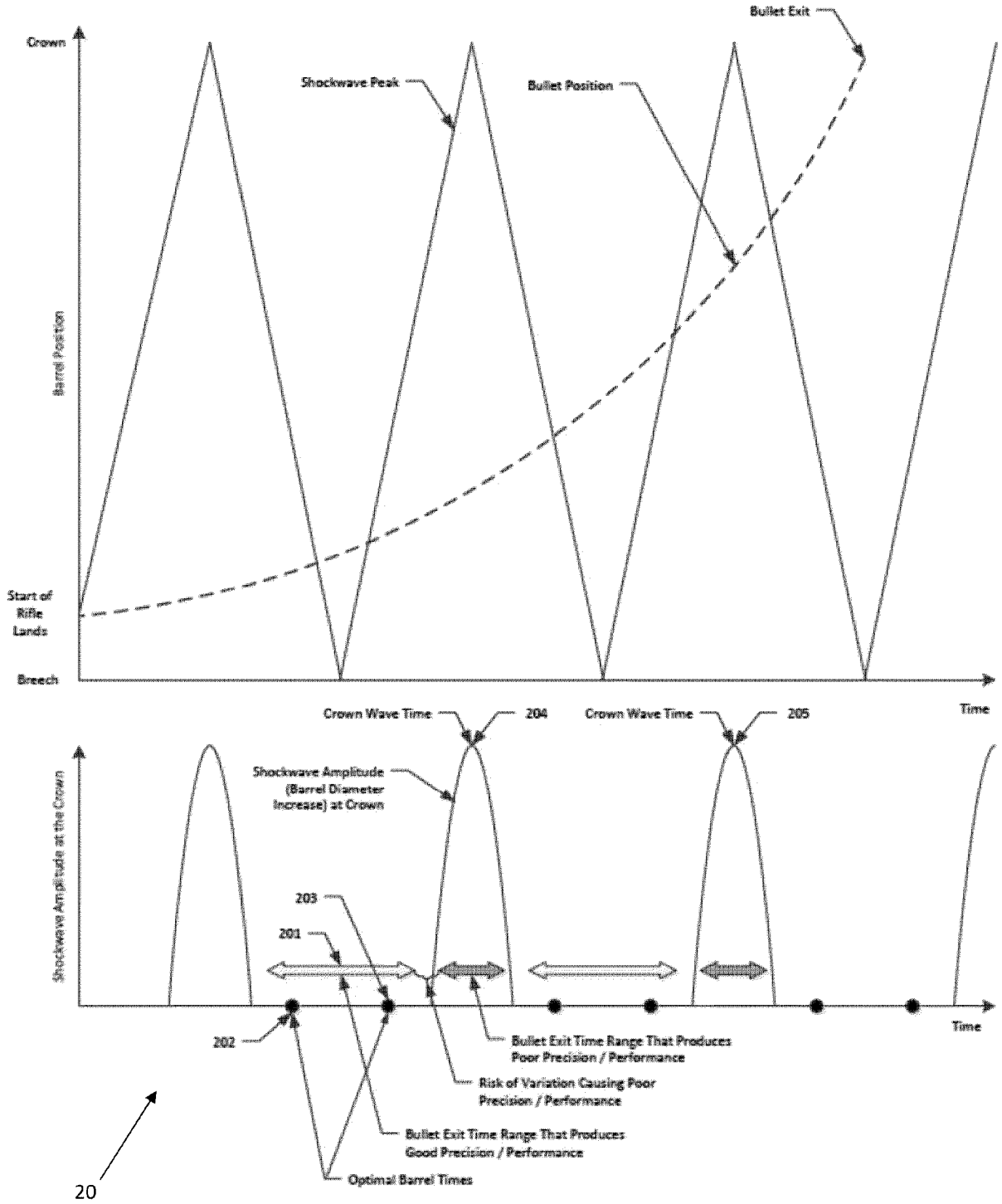
FIG. 2 is an exemplary graph of Shockwave Amplitude at the crown (change in muzzle outside diameter) vs. Time.

FIG. 2 is an exemplary graph of muzzle outside diameter vs. barrel time 20. The bullet dispersion will be similar for barrel times between the OBT's for a given wave, and for a small amount of time outside the OBT's for a given wave as it would be if the bullets were exiting at an OBT. That is to say, as long as the barrel time 20 is not too close to the time when the wave arrives at or leaves from the barrel crown 102, the load will perform well in terms of its precision (or group size on target). Although there are only 2 times per wave cycle when the barrel diameter 110 is not changing, there is a range of time 201 when it is changing slowly and very little. This range starts just before the 1$^{st}$ OBT 202 and ends just after the 2$^{nd}$ OBT 203 for each wave cycle. Even in a round designed to exit exactly at an OBT, load variation ensures that many of the rounds will not exit at exactly an OBT, so the result is essentially the same as if it were exiting in the range of time 201 just described. Note: muzzle inside diameter is really the variable of interest that affects group precision, not muzzle outside diameter. As a practical matter, it is impossible, or at least very difficult, to measure muzzle inside diameter while discharging a firearm. Given the physics of the change in barrel diameter 110 that occur from firearm discharge, the relative change in the inner diameter and outer diameter should correlate. In any case, for our purposes, understanding the magnitude of the change in diameter, which is a function of pressure, barrel geometry, etc., is less important than understanding when the diameter change occurs relative to the barrel time.

Figure 1:
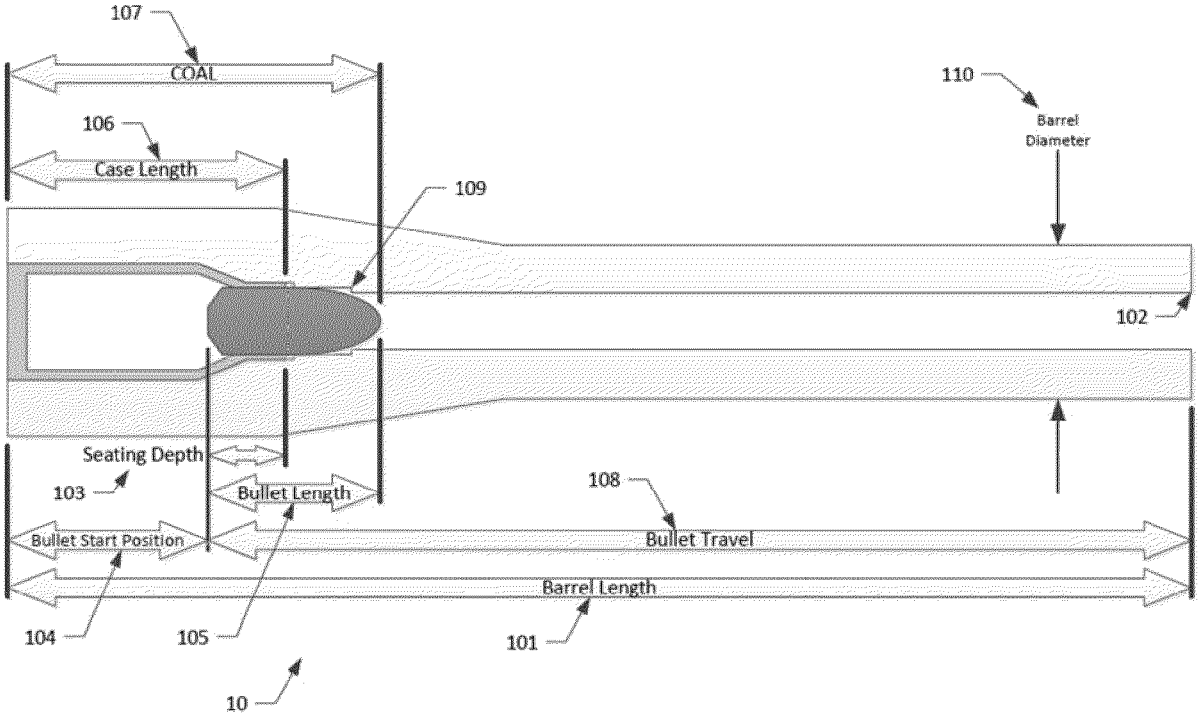
FIG. 1 is a barrel and cartridge diagram.

FIG. 1 is a barrel and cartridge diagram 10 illustrating many of the physical dimensions of interest in the design of ammunition. The longitudinal shockwave (wave) originates in the barrel somewhere between the bullet start position 104 and the beginning of a rifling 109. For calculation purposes, knowledge of the shockwave's exact point of origin is not necessary as the range of possible origin points is very small compared to the other length parameters. Any errors in assumption here will have only minor effect on the mathematical results and will simply be corrected once the test data for the specific load has been tabulated. Therefore, it is safe to assume the wave origin point is also the bullet start position 104 and go from there. The barrel time (i.e. the duration of time it takes for the bullet to exit the crown 102) is a function of a bullet travel 108 of the bullet 109 and the bullet acceleration, which is a function of the loading parameters (i.e. powder charge, etc.). Bullet travel 108 may be easily calculated with a high degree of accuracy, knowing the barrel length 101, a case length 106, and a seating depth 103. A Cartridge Overall Length (COAL) 107, must also be calculated and kept within industry specified minimum and maximum values while designing ammunition. This constraint exists to ensure rounds properly chamber into commonly manufactured firearms. The COAL 107 is a function of the case length 106, the bullet length 105, and the seating depth 103.

Knowing this information, it is possible to determine an ammunition load for a given barrel length 101, determine the barrel time compared to the times when the wave reaches the barrel crown 102, and then determine this same information for this same load, but for different barrel lengths. By choosing the barrel time carefully, the range of barrel lengths for which the barrel time falls within the desired range can be chosen, the desired range being the time intervals where the wave is not present at the crown 102. Next, by carefully determining a $2^{nd}$ load for which the barrel time is in the desired range for a barrel length 101 that the $1^{st}$ load's wave time (i.e. the time at which the vibration wave is at the barrel crown 102) is at or near, this $2^{nd}$ load can be designed to perform well for barrel lengths for which the $1^{st}$ load performs poorly. Between these 2 loads good precision can be achieved for all practical barrel lengths 101, as at least one of the loads will work well.

Referring now to FIG. 11, per the above discussion, it is illustrated that across any given barrel length 101 the presence of the wave at the barrel crown 102 can be expressed in a defined series of ranges, wherein the lack of a wave at the barrel crown 102 results in good precision. According to this figure, the barrel length 101 of a given firearm can be expressed in series of ranges of theoretical lengths between a defined set of points such as A to B, B to C, C to D, D to E, E to F, F to G etc. where each of these letters represents a point along the barrel going from the bullet start position 104 to the barrel crown 102 with A < B < C < D < E < F< G etc. In this figure, point A is the minimum practical barrel length 101 and point F is the maximum barrel length 101. Accordingly, the first load is optimized for firearms having sets of barrels with the barrel length 101 in the range of lengths depicted as A to B, C to D, E to F, etc. and the second load is optimized for firearms having sets of barrels with the barrel length 101 in the range of lengths depicted as B to C, D to E, F to G, etc. These are alternating, cyclic, sets of barrel lengths 101 that meet up end to end.

This system and method applies to both rifles and pistols. As an example, for rifles: FIGS. 6-8 illustrate how, for a given load, barrel length 101 will impact precision. By altering barrel length 101 with all else fixed, we can see that our barrel time changes with respect to the wave peaks at the end of the barrel, as measured by percent between Crown Wave Times (CWTs). CWTs are the times at which the wave is at the crown 102, the most undesirable times for bullet exit. Percent CWTs is a mathematical construct in which the CWT preceding bullet exit is set at 0% and the CWT following is set at 100%. Therefore, as an example, by keeping a load between 25% and 75% CWTs, and avoiding the ranges 0% to 25%, and 75% to 100%, we can ensure load performance even with loading tolerances. This gives us a useful metric for quantifying which barrel lengths will perform well with a given load. As an example, for pistols: FIGS. 3 - 4 illustrate this same effect. It is noteworthy however that for pistols, the distance between the CWTs is relatively smaller than it is with rifles. This is due to the relatively shorter barrel length 101.

It is also noteworthy to state that for some calibers, belted magnums for example, there might only be a few practical barrel lengths commonly manufactured and used. In these scenarios, it may be possible to, using this same method, optimize a single load to work well for the practical spectrum of barrel lengths. This is desirable from a logistical perspective to minimize the number of unique loads one must have in stock; however, the calibers where such a scenario works out will be the exception rather than the rule. In most cases, multiple loads will be required.

FIGS. 3-4, and 6-8 are all examples of specific loads in different length barrels. These graphs may all be interpreted in a similar manner, as outlined below for FIGS. 3-4. FIGS. 3-4 should be studied in conjunction with the summary provided in FIG. 5. FIGS. 6-8 should be studied in conjunction with the summary provided in FIGS. 9-10. All Figures should be studied keeping FIGS. 1-2 in reference.

FIG. 3 is a calculation input table and resulting graph 30 for an example 9 mm Luger handgun round in a 3.5-inch length barrel. The graph of FIG. 3 depicts: the shock wave position 301 in the barrel, the barrel pressure 302, and the bullet position 303. It is useful to overlay them in this manner while designing a load. Notice that the bullet exits the barrel between the 2 CWTs, CWT 1 304 and CWT 2 305 (position in barrel = 3.5 in). To understand the effect of these peaks on barrel diameter 110 it is useful to look at FIG. 2. CWT 1 204 and CWT 2 205 are times at which we expect a relatively large change in barrel diameter 110 at the barrel crown 102. While FIG. 2 is a generic graph and is not illustrative of the exact examples given in the other figures, the representation of the relative effect on barrel diameter 110 is useful to keep in mind. Continuing with FIG. 3, the barrel time 306 is .4378 milliseconds, and is 60% of the way from the dot on the left to the dot on the right. This value is highlighted in the spreadsheet section above the graph. As outlined above, 60% is a measurement of the barrel time's location with respect to the CWTs, with CWT 1 304 at 0%, and CWT 2 305 at 100%. As noted above, this is a relatively good exit time for this load at a barrel length of 3.5 inches. In FIG. 4, we see that this same load produces poor results as the barrel time of the load lines up exactly with the CWT 2 405, however, the method outlined above presents the solution to this. By constructing two loads with sufficiently different barrel times, a solution exists to have at least one good load for any given barrel length 101.

Knowing this, we can now fully understand FIG. 5, which is an illustration of 2 different example 9 mm Luger loads that have been designed for an example range of barrel lengths from 3.5 inches to 6.0 inches, such that each barrel length in the range will have more optimal performance with one load or the other. In this example, one load performs well for 3.5, 4.5, 5.5, and 6.0 inch barrels, but performs poorly for 4.0 and 5.0 inch barrels. A $2^{nd}$ load of this same bullet performs well for 4.0 and 5.0 inch barrels, but performs poorly for 3.5, 4.5, 5.5, and 6.0 inch barrels.

The left section of the table summarizes one of the loads for barrels ranging in length from 3.5 in to 6.0 in. The table shows that barrel lengths of 3.5 in, 4.5 in, and 6.0 in have barrel times that are close to being in the middle between the CWTs. Barrel length of 5.5 in is about 76% of the way between two of these times, which is nearly one of the optimum barrel times, but getting close to an exit time which could be sensitive to normal variation. In these cases, the bullets will perform well. Barrels that are 4.0 in and 5.0 in in length result in the bullet exiting at or very near a time when the shock wave is at the barrel end. In these cases, the bullets will perform poorly.

The right section of the table above shows a load that is slightly different than the one on the left (4.3 gr instead of 4.1) which results in a different barrel pressure. The barrel time for each barrel length 101 is slightly different compared to the table on the left. The result is a barrel time that results in good performance for 4.0 in, 5.0 in, and 5.5 in barrels, but poor performance for 3.5 in, 4.5 in, and 6.0 in. With these two loads and the information about which barrel lengths they will perform well in; a shooter can select one that will work well with their individual gun.

In pistols, the short barrels account for the much shorter cyclic nature between good and poor performance. Many pistol models have barrels that are between x0.0 and x0.5 or between x0.5 and x+1.0 inches in length. For this reason, to achieve optimum performance over the entire range of pistol barrel lengths, it might be advantageous in some cases to design 3 loads instead of 2, but in all cases 2 loads will be a vast improvement over common industry practice of the day which does not factor this in at all.

FIG. 6 is an illustrative example of a .308 load being shot out of a 24-inch rifle barrel. In this example, the bullet exits the 24 in barrel near the optimum barrel time 202 and well within the time range where the shock wave is not near the muzzle. FIG. 7 shows the effect of the increase in barrel length 101 of 2 in from 24 in to 26 in shows only a small change in the barrel time relative to the CWTs. FIG. 8 illustrates what happens to this same load if the barrel length is decreased to 20 in. In this case, the bullet is exiting the barrel almost exactly when the shock wave is at the crown 102 (i.e. at one of the CWTs), leading to poor performance.

FIGS. 9 & 10 are additional illustrations of the principles outlined above for FIG. 5. In a rifle, the same wave phenomenon occurs, but due to the longer barrel length the shock wave takes much more time to travel the length of the barrel. The result is that instead of a very short change in barrel length having a big effect on the ammunition load's performance, there is a larger range of lengths for which there is good and poor performance. FIG. 9 illustrates one load in .308 performs well for 16 to 18 inch barrels, performs poorly for 19 to 22 inch barrels, and then performs well again for 23 to 26 inch barrels. FIG. 10 illustrates a $2^{nd}$ load of this same bullet and caliber performs poorly for 16 to 18 inch barrels, performs well for 19 to 22 inch barrels, and then performs poorly again for 23 to 26 inch barrels. With the two .308 loads above and the information about which barrel lengths they will perform well in, a shooter may select one that will work well with their individual rifle.

Transverse waves are an additional vibration pattern that occurs normal to the barrel axis. It is often referred to as barrel whip. The frequency and amplitude of this type of wave are dependent on barrel geometry, but the dominant variable in the equation which describes the vibration is the barrel length 102, and this type of vibration is generally much slower than the longitudinal shock wave.

For pistols, due to the relatively short and thick nature of the barrels, transverse waves can essentially be ignored. For rifles, due to the relatively long and thin nature of the barrels, they should be considered in order to obtain optimal bullet precision.

As various studies and prior art have demonstrated, ideally the bullets should exit the barrel when the waveform is rising and near a peak. As a practical matter, this can be evaluated during load testing by evaluating the movement of the centers of the various groups with the goal being to find the load which produces the least movement of the group center. If this testing is done with a lightweight barrel, then heavier barrels (i.e. bull barrels), which are stiffer, will produce less movement of the group center. Since there are multiple sets of CWTs between which the bullet exit may be set, designing a load to be insensitive to both modes of vibration is readily achievable.

The system and method described above allows for the manufacture of standard bullet loads that will perform well in pistols and rifles with specific ranges of barrel lengths. This allows the shooter to choose one of these loads for any given bullet that will work well with their particular firearm without randomly testing various one-size-fits-all bullet loads in a trial and error method until one is found that performs acceptably and without developing their own custom loads. Such a product is not offered on the market today.

The use of internal ballistics software, such as Quick-Load, enables an approximate load to be determined. Test rounds are then prepared according to the load calculations. These rounds are fired from an appropriate firearm, the velocity is measured, and, when practical, instrumentation is applied to the barrel to determine the internal pressure and barrel time. This data is then compared to the predicted performance. If a relatively large adjustment is needed, the powder load can be increased or decreased slightly. If only a minor adjustment is needed, then the bullet seating depth 103 can be increased or decreased slightly to achieve the best precision. The performance can then be reevaluated in the firearm and confirmed in 1 or more additional firearms with different barrel lengths.

While the invention has been described above in terms of specific embodiments, it is to be understood that the invention is not limited to these disclosed embodiments. Upon reading the teachings of this disclosure many modifications and other embodiments of the invention will come to mind of those skilled in the art to which this invention pertains, and which are intended to be and are covered by both this disclosure and the appended claims. It is indeed intended that the scope of the invention should be determined by proper interpretation and construction of the appended claims and their legal equivalents, as understood by those of skill in the art relying upon the disclosure in this specification and the attached drawings.

What is claimed is:

1. An ammunition for a given caliber of a projectile, the ammunition comprising:

at least two loads, a first load of the at least two loads selected for use in firearms having a first barrel length within a first set of predetermined barrel lengths, and a second load of the at least two loads selected for use in firearms having a second barrel length within a second set of predetermined barrel lengths, wherein the first load is optimized only for the first set of predetermined barrel lengths, but not the second set of predetermined barrel lengths, and the second load is optimized only for the second set of predetermined barrel lengths, but not the first set of predetermined barrel lengths.

2. An ammunition of claim 1, wherein the first set of barrel lengths and the second set of barrel lengths comprise a range of all possible barrel lengths.

3. An ammunition of claim 1, wherein a given load of the at least two loads are selected by a user based upon the barrel length of their firearm.

4. An ammunition of claim 1, wherein the optimization is based upon a time that the projectile travels in each barrel length within the first set of predetermined barrel lengths or within the second set of predetermined barrel lengths.

5. An ammunition of claim 4, wherein the time the projectile travels in the barrel is specified so that it does not coincide closely with the arrival of a shockwave at a barrel crown for the first set of predetermined barrel lengths and not for the second set of predetermined barrel lengths.

6. An ammunition of claim 5, wherein the time the projectile travels in the barrel is specified so that it coincides closely with a time when a transverse wave is rising and near a peak for a first set of predetermined barrel lengths and not for a second set of predetermined barrel lengths.

7. An ammunition of claim 4, wherein the time that the projectile travels in each barrel length within the first set of predetermined barrel lengths or within the second set of predetermined barrel lengths is adjusted through a combination of powder charges and bullet seating depth.

* * * * *